US009187963B2

(12) United States Patent
Richards

(10) Patent No.: US 9,187,963 B2
(45) Date of Patent: Nov. 17, 2015

(54) LOW PROFILE CLAMP FOR A WELLBORE TUBULAR

(75) Inventor: William M. Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 747 days.

(21) Appl. No.: 13/549,396

(22) Filed: Jul. 13, 2012

(65) Prior Publication Data

US 2014/0014373 A1 Jan. 16, 2014

(51) Int. Cl.
*E21B 17/02* (2006.01)
*E21B 17/10* (2006.01)

(52) U.S. Cl.
CPC ..... *E21B 17/026* (2013.01); *E21B 17/1035* (2013.01)

(58) Field of Classification Search
CPC ..... E21B 17/02; E21B 17/023
See application file for complete search history.

(56) References Cited

U.S. PATENT DOCUMENTS 3,806,168 A * 4/1974 McGee et al. ..... 285/123.2
4,986,350 A 1/1991 Czernichow
5,803,170 A 9/1998 Garcia-Soule et al.
5,973,270 A 10/1999 Keller
6,554,064 B1 4/2003 Restarick et al.
6,817,410 B2 11/2004 Wetzel et al.
6,848,510 B2 2/2005 Bixenman et al.
6,988,555 B2 1/2006 Uhlenkott
7,431,082 B2 10/2008 Holt et al.
7,784,537 B2 8/2010 Baxter
2002/0007948 A1 1/2002 Bayne et al.
2003/0168221 A1 9/2003 Zachman
2004/0168794 A1 9/2004 Vold
2004/0206511 A1* 10/2004 Tilton et al. ..... 166/380
2011/0303419 A1* 12/2011 Maier ..... 166/373
2012/0312523 A1* 12/2012 Joseph et al. ..... 166/65.1

* cited by examiner

*Primary Examiner* — William P Neuder

(74) *Attorney, Agent, or Firm* — Scott Richardson; Baker Botts L.L.P.

(57) ABSTRACT

A clamp system for use with a wellbore tubular comprises a wellbore tubular having a circumferential groove and a clamp, and the circumferential groove is configured to retain the clamp within the circumferential groove. The clamp system can be used to secure a control line to a wellbore tubular, which can comprise retaining the control line to an outside of a wellbore tubular that comprises the circumferential groove and resisting a force applied to the control line by transferring the force to the circumferential groove.

22 Claims, 14 Drawing Sheets

LOW PROFILE CLAMP FOR A WELLBORE TUBULAR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 20,000 feet from the surface.

A variety of equipment may be used to complete the wellbore. A packer with sand screens and variable chokes may be set in the wellbore. The well may be hydraulically fractured with sized proppant suspended in fracturing fluid. The well may be chemically treated with acids. In many well completions, communicating with a downhole tool to measure or actuate is desirable. The signal may be conveyed by a control line coupled to a tool string.

SUMMARY

In an embodiment, a method of securing a control line to a wellbore tubular comprises retaining the control line to an outside of a wellbore tubular that comprises a circumferential groove, and resisting a force applied to the control line by transferring the force to the circumferential groove.

In an embodiment, a method of coupling a control line to an outside of a wellbore tubular, comprises placing at least a portion of a clamp in a circumferential groove in the wellbore tubular; and sliding at least the portion of the clamp in the circumferential groove to engage a retaining lip of the circumferential groove. The clamp is configured to retain the control line adjacent the wellbore tubular.

In an embodiment, a clamp system for use with a wellbore tubular comprises a wellbore tubular having a circumferential groove and a clamp, and the circumferential groove is configured to retain the clamp within the circumferential groove.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
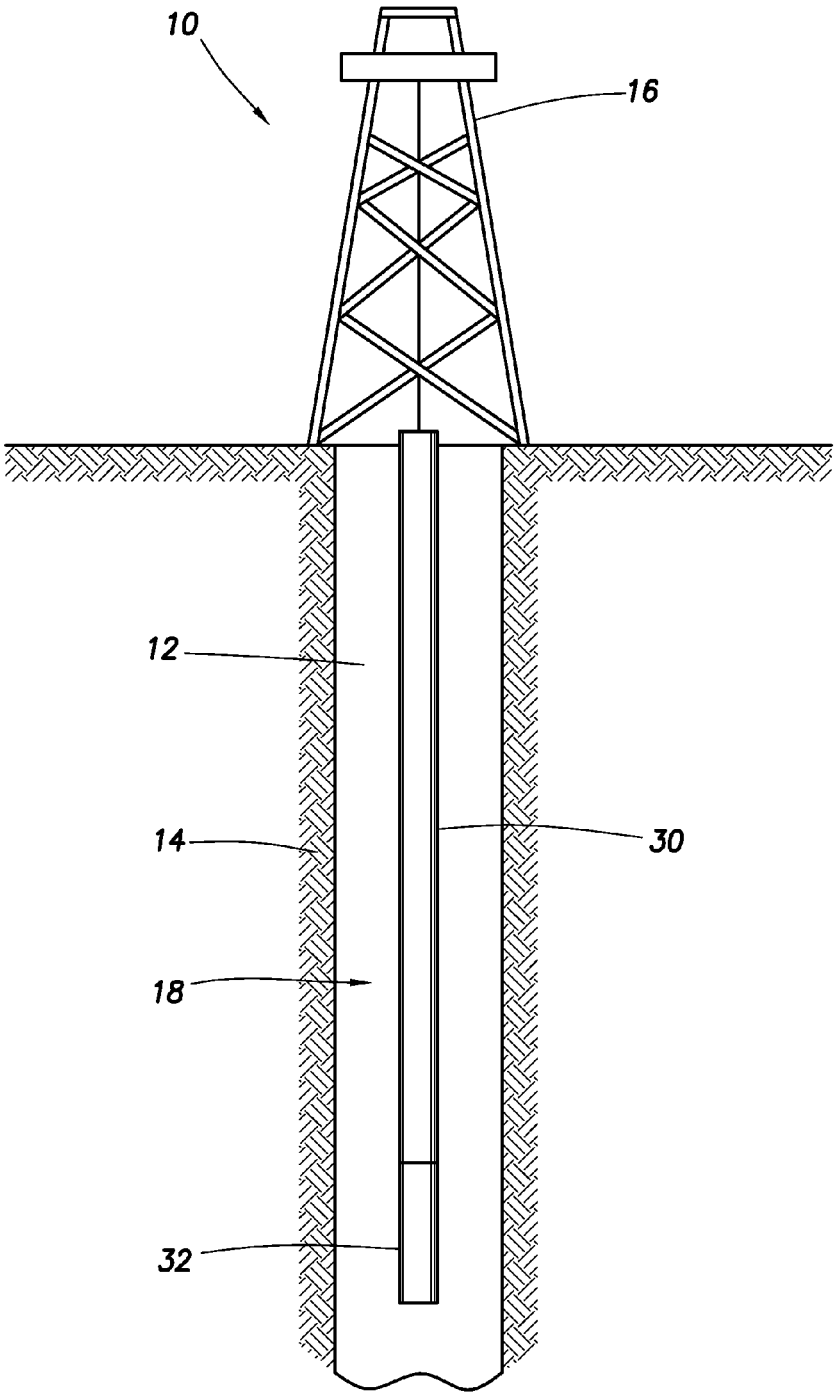
FIG. 1 is an illustration of a wellbore, a conveyance, and a bottom hole assembly according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

A completion string and/or a production string may be installed in a wellbore to promote production of hydrocarbons from the wellbore, for example after a wellbore has been drilled, cased, and perforated. The completion and/or production string may comprise a series of tubular components (e.g., wellbore tubulars, casing joints, pipe joints, coiled tubing, etc.) and may incorporate one or more completion and/or production tools for producing from one or more subterranean formations. Completion and/or production tools may comprise sand control screens (e.g., sand screens, sand screen shrouds, sand screen end rings, sand screen middle rings, etc.), fluid flow control devices, wellbore isolation devices (e.g., safety valves), packers, travel joints, couplers, chemical injection devices, gauge mandrels, downhole gauges, and/or other tools. The lower part of the completion may include various sensors, such as electronic gauges and fiber optic cable, located across from the formation adjacent to the sand screens. These sensors may measure pressure, temperature, and/or flow rates from produced fluids.

After the completion and/or production string is installed in the wellbore, some of the completion and/or production tools, such as flow control devices, may be triggered to activate or actuate. Some of the flow control devices may be variable chokes that meter the flow rate of produced fluids. These types of devices may rely upon position measurement along with an actuation signal to operate. Some completion and/or production tools may be triggered to activate shortly after the completion and/or production string is installed in the wellbore while other completion and/or production tools may be triggered to activate at a later time, for example a year later or years later. Some completion and/or production tools may be cycled back and forth between operational states or modes after the completion and/or production string is installed in the wellbore.

In an embodiment, the completion and/or production tools may be controlled or triggered via a control line extending from the completion and/or production tools to the surface. The control line may be retained and coupled to the completion and/or production tool by a series of clamps. The control line may convey a signal from the surface to the completion and/or production tool or tools, for example a hydraulic signal, a pneumatic signal, an electrical signal, an optical signal, or another signal. The control line may comprise a single or multiple wires, cables, and/or wave guides. The control line may comprise a hollow line suitable for containing fluid. The control line may comprise one or more optical fibers.

In an embodiment, a low profile clamp is taught. The low profile clamp may be used for retaining the control line and coupling the control line to a wellbore tubular (e.g., the completion and/or production tubulars and/or tools). The low profile clamp may prevent the control line from hanging or dangling away from the completion and/or production string and possibly catching on protruding features in the wellbore. The low profile clamp may promote the control line resisting axial, radial, and/or circumferential forces that may be applied to the control line when running the completion and/or production string into the wellbore. The low profile clamp may engage with or be captured by a circumferential groove in a wellbore tubular component incorporated in the completion and/or production string. The circumferential groove may be undercut or dove tailed such that the low profile clamp, once inserted into the circumferential groove, is captured and prevented from moving axially up or down the tubular. A variety of low profile clamp embodiments are described in detail hereinafter.

In an embodiment, part of the low profile clamp is located radially below the surface of the wellbore tubular component, within the circumferential groove, which reduces the profile and/or protrusion of the clamp relative to the surface of the tubular component. This reduced profile promotes reduced interference between the clamp and the wellbore or any protrusions in the wellbore. In an embodiment, the low profile clamp may be slid into position in the circumferential groove and then set in position within the circumferential groove by setting a set-screw, by hammering a deformable pin into place to engage the tubular component, by deforming a tab of the low profile clamp to engage the tubular component, by deforming an edge of the circumferential groove, or by performing another action.

The low profile clamp may have an axial groove to receive at least a portion of the control line or two axial grooves to receive two separate control lines. The tubular component may have an axial groove that is deep enough to receive at least about half of the diameter of the control line, and the low profile clamp may have an axial groove that is deep enough to receive at least about half of the diameter of the control line, where the axial groove in the low profile clamp is open towards the axial groove in the tubular component when the low profile clamp is installed and coupled to the circumferential groove.

Turning now to FIG. 1, a wellbore completion system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure that supports a completion string 18 or production string in the wellbore 12. In other embodiments a different structure may support the completion string 18, for example an injector head of a coiled tubing rigup. In an embodiment, the servicing rig 16 may comprise a derrick with a rig floor through which the completion string 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the completion string 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the completion string 18 may comprise a liner with float equipment. The control line is coupled to the completion string 18 by plurality of low profile clamps. The liner is cemented in place with use of the float equipment. A completion string of packers, sand screen, production tubing is lowered into the liner. The control line on the outside of the liner maybe connected to electronic gauges that measure pressure, temperature, stress to the casing to measure compaction. Likewise the control line may have fiber optic measuring pressure, temperature, or compaction. The liner may be perforated below the gauges.

In an embodiment, the completion string 18 may comprise various wellbore tubulars such as production tubing 30, completion tool 32, and/or other tools and/or subassemblies (not shown) located above or below the completion tool 32. The production tubing 30 may comprise any of a string of jointed pipes, a coiled tubing, and tubing or tubulars for conveying hydrocarbons to the surface. In an embodiment, a control line may be coupled to the completion string 18 by a plurality of low profile clamps.

In an embodiment, tubing having one or more control lines coupled to it by low profile clamps is run in into the wellbore. A tool is activated based at least in part on an actuation trigger signal transmitted via the control line. The tubing is conveyed part-way out of the wellbore. A second tool, for example a packer, may be actuated in response to another actuation trigger signal transmitted via the control line when the tubing is part-way pulled out of the wellbore. After the packer is set, a well head is placed on the well. After the well head is installed, yet another tool may be actuated in response to yet another trigger signal transmitted via the control line.

Turning now to FIG. 2A, FIG. 2B, FIG. 2C, FIG. 2D, FIG. 2E, and FIG. 2F, a first low profile clamp assembly system 100 is described. In an embodiment, the system 100 comprises a tubular 102, a circumferential groove 104, and a clamp assembly 106. The tubular 102 may be a coupling between two pipe joints, a pipe joint, coiled tubing, a completion tool, a sand screen, a section of casing, and/or other generally cylindrical metal structure that may be incorporated into the completion string 18. In some contexts, the tubular 102 may be referred to as a wellbore tubular, a completion tubular, and/or a production tubular. The central axis of the tubular 102 generally aligns with the central axis of the completion string 18 proximate to the tubular 102. It is understood that the completion string 18 may comprise any number of systems 100 along its length to retain and secure a control line 108 that runs from the surface at a location of the wellbore 12 to the completion tool 32. In an embodiment, the systems 100 may be located at least about every 2 feet along the completion string 18. Alternatively, in an embodiment, the systems 100 may be located at least about every 4 feet along the completion string 18. In an embodiment, the systems 100 may be located one per joint of pipe, two per joint of pipe, three per joint of pipe, four per joint of pipe, or more per joint of pipe. In some embodiments, the systems 100 may be placed according to different spacings at different points along the completion string 18. For example, the spacings of the systems 100 may be nearer together for the downhole portion of the completion string 18 to a certain point associated to a depth of a feature of the wellbore 12 or the casing of the wellbore 12 and the spacings of the systems 100 above that point in the completion string 18 may be spaced apart more widely.

The circumferential groove 104 may generally extend around at least a portion of the circumference of the tubular 102. Alternatively, the circumferential groove 104 may extend completely around the circumference of the tubular 102. The circumferential groove 104 may be formed in the tubular 102 using any of a variety of methods. The circumferential groove 104 may be formed by a combination of milling and cutting machining operations. The circumferential groove 104 is undercut on one side by a first undercut 110 and on a second side by a second undercut 112 of the circumferential groove 104, for example as shown in FIG. 2E. The axial width X of the inner surface of the circumferential groove 104 may be greater than the axial width of Y of the circumferential groove 104 at the surface of the tubular 102. These surfaces 110, 112 may be referred to in some contexts as a retaining lip. The undercutting of the circumferential groove 104 may be square shouldered, as seen in FIG. 2E. Alternatively, in an embodiment, the undercutting of the circumferential groove 104 may form a dovetail socket, as seen in FIG. 2F. In another embodiment, a different geometry of undercutting may be employed. The tubular 102 may comprise one or more openings 118 where the circumferential groove 104 is cut out beyond the undercutting, allowing sliding access of the clamp assembly 106 into the circumferential groove 104. Once the clamp assembly 106 and or components of the clamp assembly 106 have been introduced into the circumferential groove 104 and slid beyond the opening 118, the clamp assembly 106 may be retained from radial or axial translation by the undercuts 110, 112 of the circumferential groove 104 while still being capable of translating along the circumferential length of the circumferential groove 104. In an embodiment, the circumferential groove 104 may be from about ⅛ inch deep to about ¼ inch deep. In an embodiment, the circumferential groove 104 is about 3⁄16 inch deep. In an embodiment, the control line 108 is about ¼ inch in diameter. The tubular 102 may comprise an axial groove 120 that opens outwards for receiving the control line 108 partially. For example, the axial groove 120 may be from about ⅛ inch deep to about ¼ inch deep.

The clamp assembly 106 may be embodied in a plurality of different structures to satisfy a variety of different design criteria and to balance design trade-offs. In some embodiments, the clamp assembly 106 may be composed of two or more parts. In other embodiments, the clamp assembly 106 may be implemented as a single part. The clamp assembly 106 may incorporate an axial groove in at least one of its components that may be placed over the control line 108 to retain and support the control line 108 when the clamp assembly 100 is assembled and/or installed.

Figure 2A:
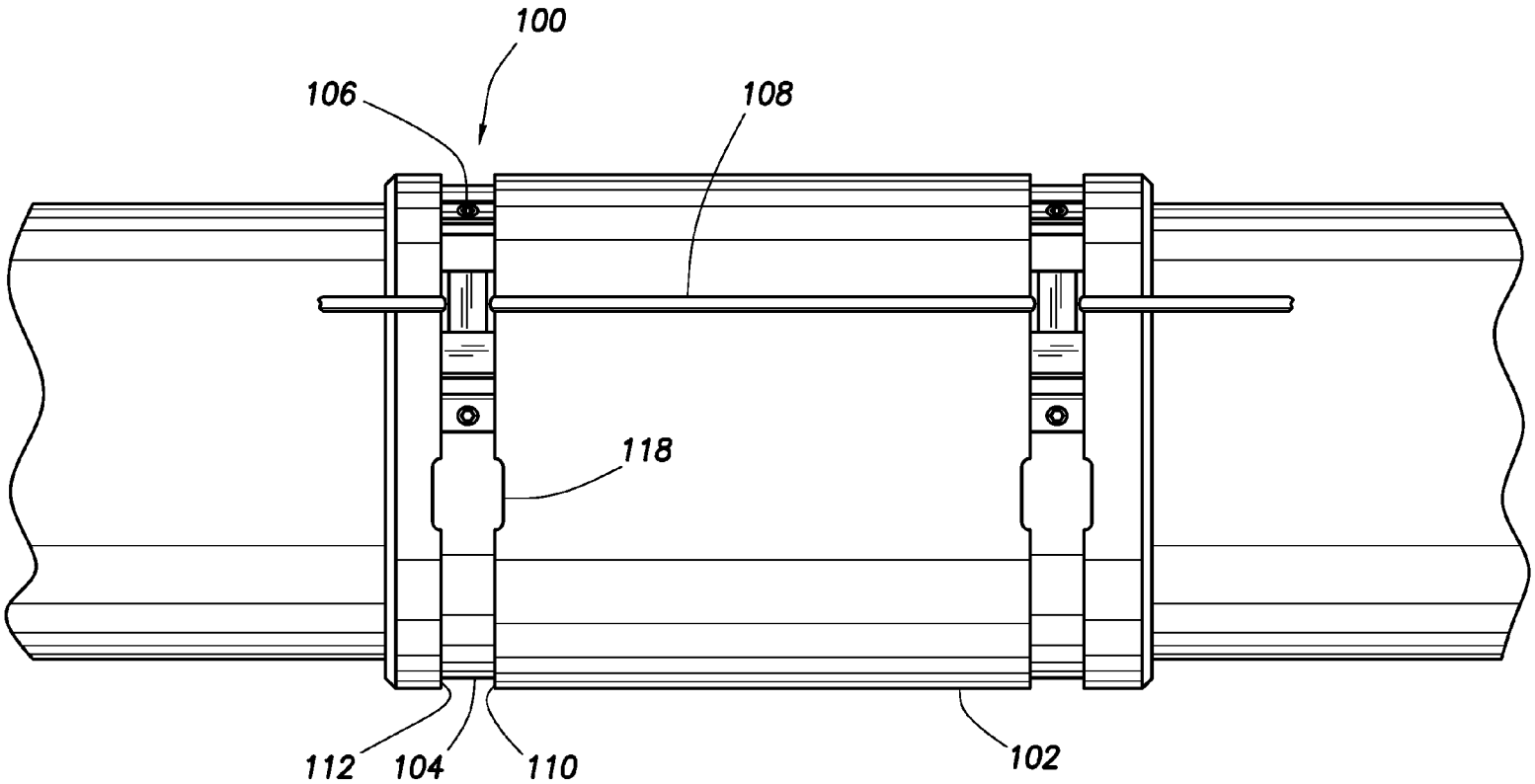
FIG. 2A is an illustration of a clamp assembly, a tubular component, and a control line according to an embodiment of the disclosure.
Figure 2B:
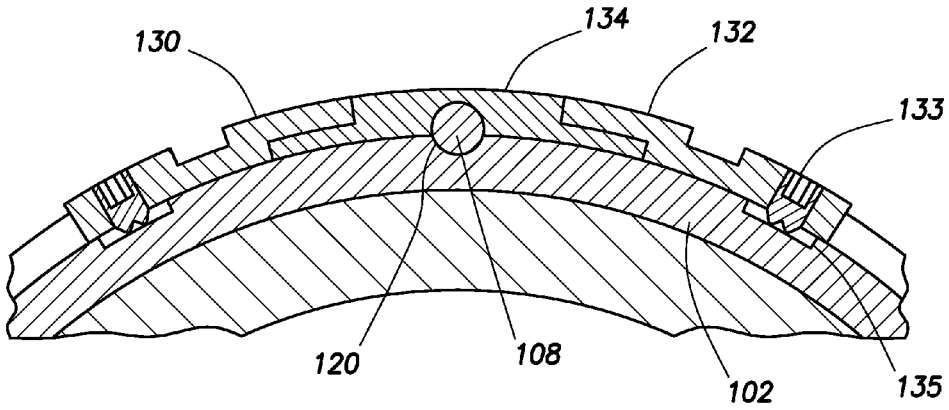
FIG. 2B is an illustration of a clamp assembly in section according to an embodiment of the disclosure.
Figure 2C:
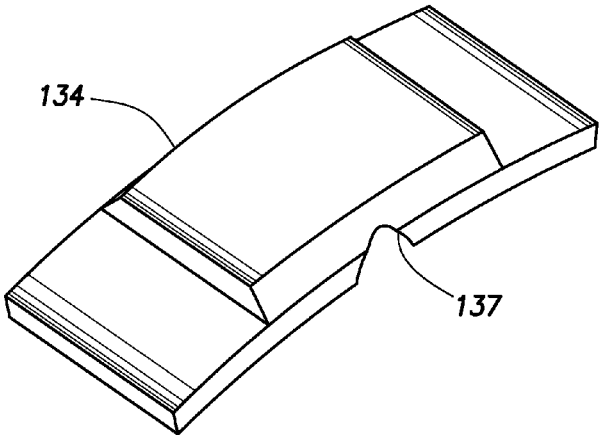
FIG. 2C is an illustration of a clamp retainer of a clamp assembly according to an embodiment of the disclosure.

In an embodiment as shown in FIG. 2B the clamp assembly 106 comprises a first end clamp 130, a second end clamp 132, and a clamp retainer 134. The end clamps 130, 132 are sized to be retained by the undercutting 110, 112 of the circumferential groove 104. For example, the distance between the edges of the end clamps 130, 132 that are substantially parallel to the circumferential groove 104 are separated by more than the distance Y and less than the distance X shown in FIG. 2E. Said in another way, the end clamps 130, 132 may have a circumferential width greater than the circumferential width of the groove 104 at the surface of the tubular 102, where circumferential width is understood to be the width relative to a circumferential line or arc. The end clamps 130, 132 are each undercut at one end. The clamp retainer 134 may not be as wide as the circumferential groove 104 and may be able to be inserted directly into the circumferential groove 104 without inserting via the opening 118. The clamp retainer 134 is overcut at both ends. The clamp retainer 134 comprises an axial groove 137 that opens radially inwards, towards the tubular 102, when the clamp retainer 134 is assembled into the clamp assembly 106. In an embodiment, the first end clamp 130 is structurally similar or equivalent to the second end clamp 132. One skilled in the art will readily appreciate that the end clamps 130, 132 may be used on either side of the axial groove 120 by rotating 180 degrees.

Figure 2D:
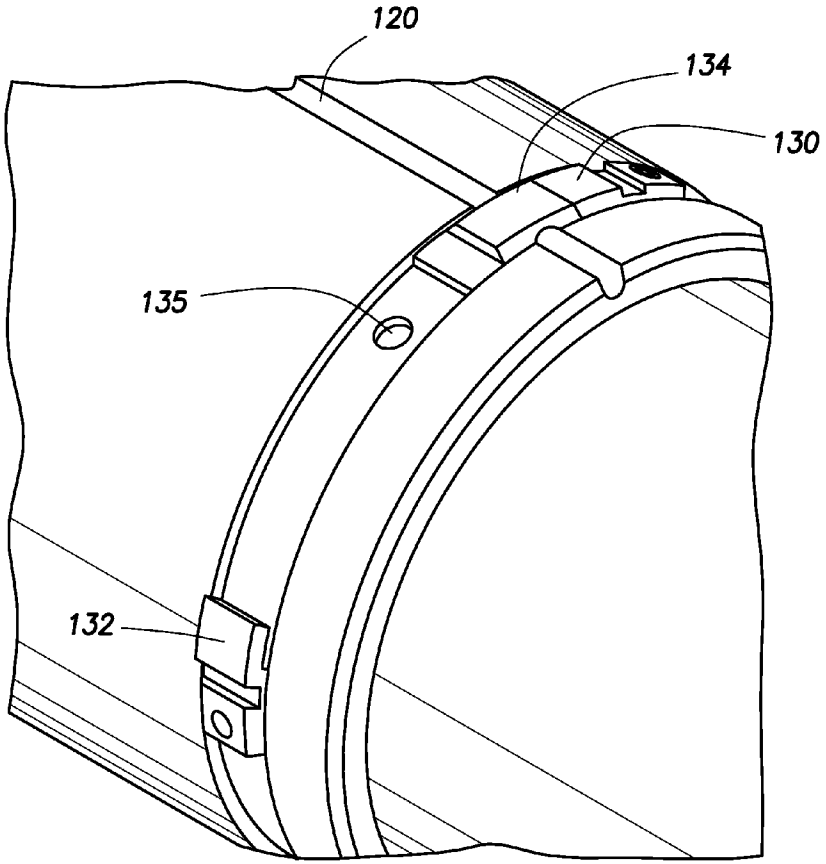
FIG. 2D is an illustration of a clamp assembly according to an embodiment of the disclosure.
Figure 2E:
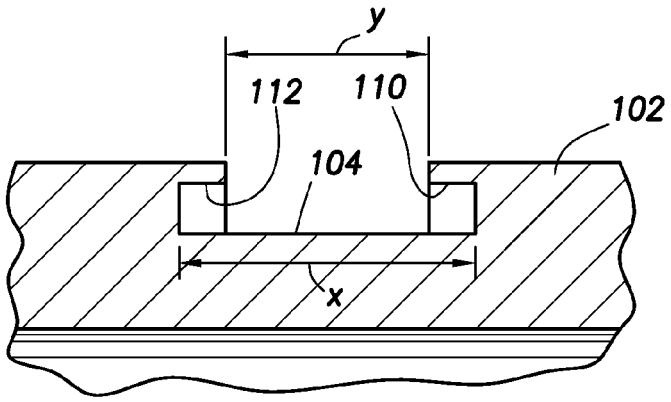
FIG. 2E is an illustration of a first undercut groove of in a surface of a tubular according to an embodiment of the disclosure.
Figure 2F:
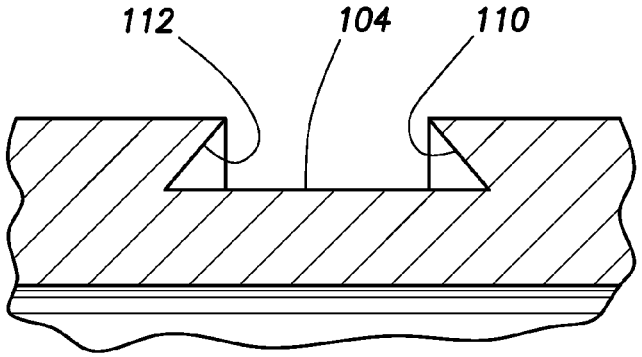
FIG. 2F is an illustration of another undercut groove of a surface of the tubular according to an embodiment of the disclosure.

When the clamp assembly 106 is assembled to retain the control line 108, the first end clamp 130 may be inserted into the circumferential groove 104 via the opening 118 and slid into position proximate to the axial groove 120, with its undercut edge towards the axial groove 120. The second end clamp 132 may also be inserted into the circumferential groove 104 via the opening 118 and slid into position proximate to the axial groove 120, its undercut edge towards the axial groove 120. It should be noted that one of the end clamps 130, 132 may be slid in the circumferential groove 104 in one direction while the other of the end clamps 130, 132 may be slid in the circumferential groove 104 in the opposite direction to reach a position suitable for capturing the clamp retainer 134. The control line 108 may be held in the axial groove 120, the clamp retainer 134 may be placed over the control line 108 and into the circumferential groove 104, the undercut edges of the first and second end clamps 130, 132 may be slid over the overcut ends of the clamp retainer 134 to hold it in place, and the end clamps 130, 132 may be secured in position with one or more retaining mechanism 133 that engage the end clamps 130, 132. The retaining mechanism 133 is generally configured to resist circumferential movement of the end clamps 130, 132 or similar parts when engaged with the circumferential groove 104 and/or the tubular 102. The retaining mechanism 133 may comprise set screws are threaded into the end clamps 130, 132 and/or deformable pins that are hammered into place to secure the end clamps 130, 132. Alternatively, the end clamps 130, 132 may be retained in position by peening down or peening in the edges of the circumferential groove 104. The peened edges of the circumferential groove 104 may be referred to as an embodiment of the retaining mechanism 133. Yet other embodiments of retaining mechanism 133 are contemplated by the present disclosure. FIG. 2D in part illustrates a possible in-progress installation of the clamp assembly 106.

In an embodiment, the tubular 102 may have counter sunk holes 135 corresponding to the retaining mechanisms 133 cut into the surface of the circumferential groove 104. When the retaining mechanisms 133 are installed, they may engage with the counter sunk holes and secure the end clamps 130, 132 from sliding in the circumferential groove 104. In another embodiment, the retaining mechanisms 133 may secure the end clamps 130, 132 from sliding simply by friction between the ends of the retaining mechanisms 133 and the surface of the circumferential groove 104. In an embodiment, a deformable pin may be hammered into a hole cut in the end clamps 130, 132 to secure the end clamps 130, 132 from sliding in the circumferential groove 104. The edges of the circumferential groove 104 may be deformed or peened inwardly to wedge or otherwise secure the end clamps 130, 132 from circumferential movement.

In an embodiment, the end clamps 130, 132 and the clamp retainer 134 may project radially outwards from the outer surface of the tubular 102 when installed to make the clamp assembly 106. For example, the end clamps 130, 132, and/or clamp retainer 134 may project at least about ⅛ inch above the outer surface of the tubular 102. The edges of the end clamps 130, 132, and/or the clamp retainer 134 may be beveled where they project above the outer surface of the tubular 102 to reduce interference with the wellbore 12 or structures within the wellbore 12 such as casing joints and other structures during conveyance of the tubular 102 within the wellbore 12. Alternatively, in an embodiment, the end clamps 130, 132, and/or the clamp retainer 134 may be flush with the outer surface of the tubular 102 or even recessed below the outer surface of the tubular 102 when the clamp assembly 106 is assembled.

The clamp assembly 106 may be assembled by a worker when the completion string 18 is being run into the wellbore 12. For example, a worker may be stationed on the floor of the rig 16 or on a platform above the floor. As the completion string 18 is made up, the control line 108 may be fed from a continuous spool and over a pulley, a goose neck, or some other device to avoid kinking the control line 108 by bending it over too short a radius. The worker assembles the clamp assembly 106 to retain the control line 108 as the completion string 18 feeds into the wellbore 12.

Figure 3A:
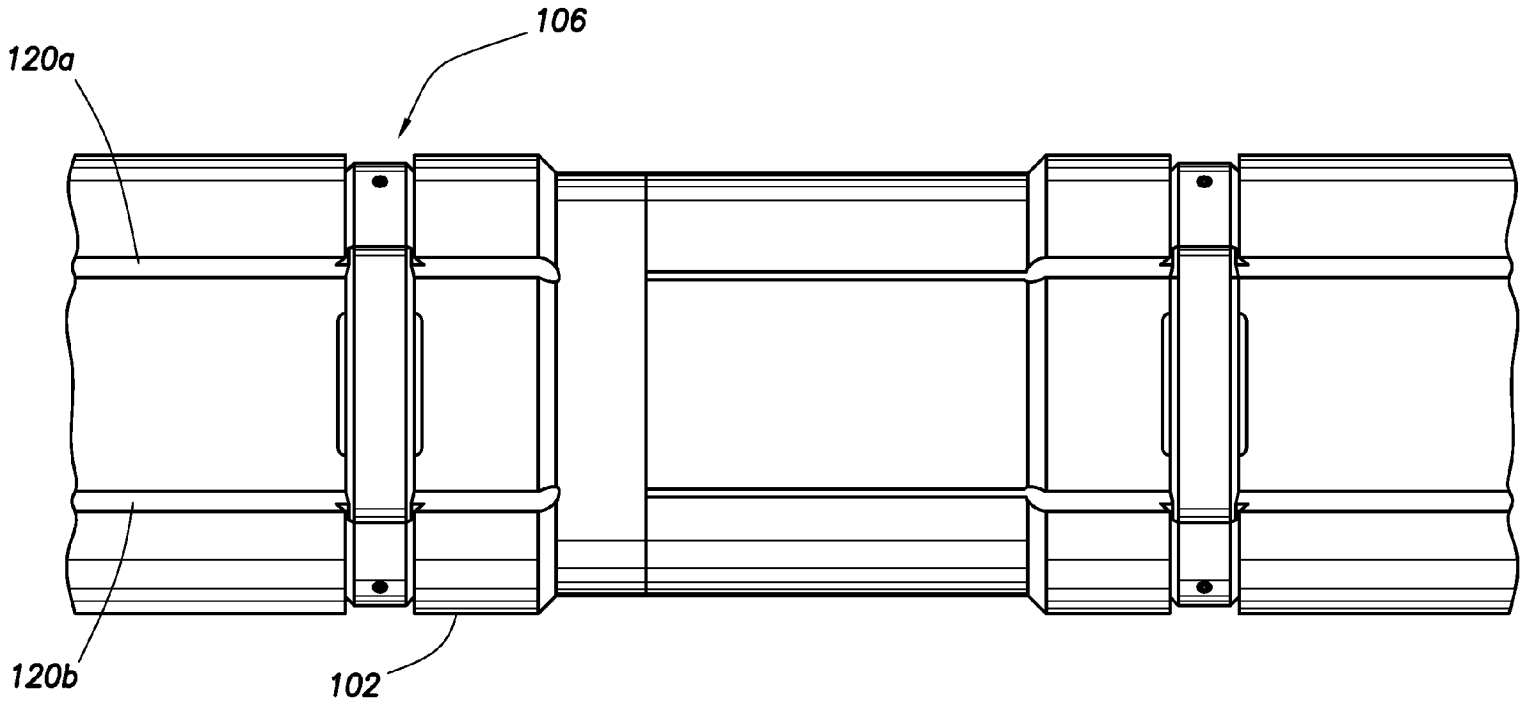
FIG. 3A is an illustration of a clamp assembly and a tubular according to an embodiment of the disclosure.
Figure 3B:
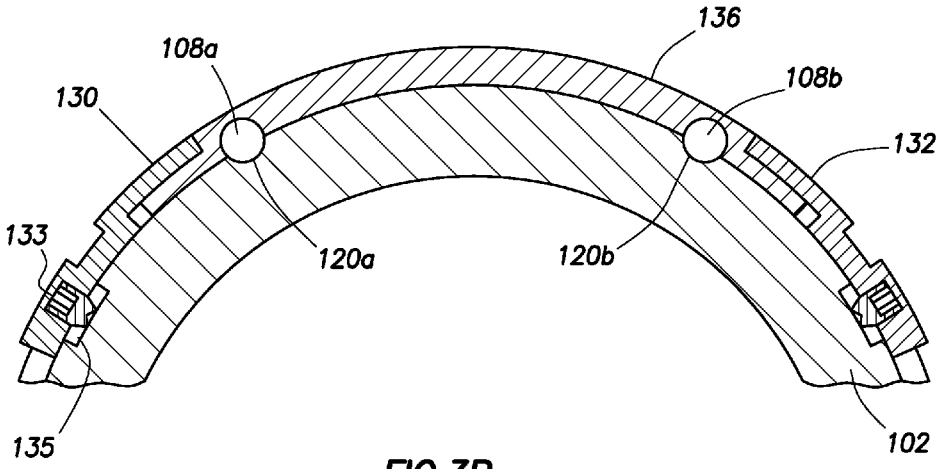
FIG. 3B is an illustration of a clamp assembly in section according to an embodiment of the disclosure.
Figure 3C:
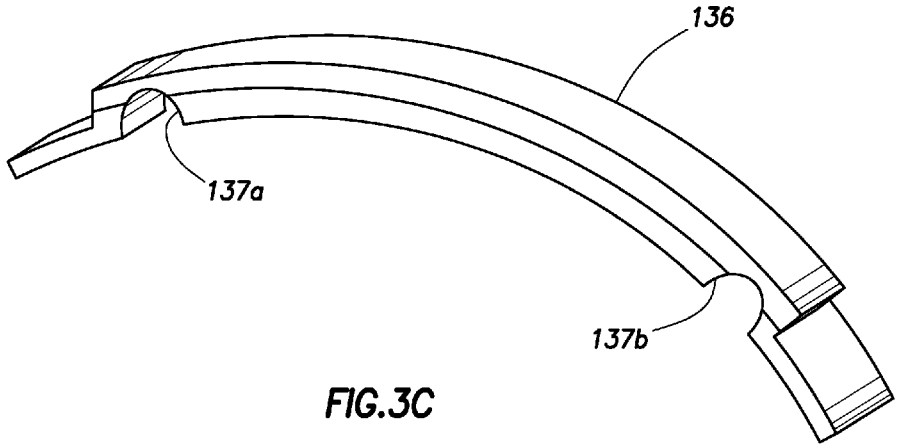
FIG. 3C is an illustration of a clamp retainer of a clamp assembly according to an embodiment of the disclosure.

Turning now to FIG. 3A, FIG. 3B, and FIG. 3C, an alternative embodiment of the clamp assembly 106 is described. In an embodiment, the clamp retainer 136 may comprise two axial grooves 137*a* and 137*b*, the tubular 102 may comprise two axial grooves 120*a* and 120*b*, and one or more control lines 108*a* and 108*b* may be retained by the clamp assembly 106. In this embodiment, the clamp assembly 106 may be assembled as described with respect to FIG. 2A through FIG. 2F. While FIG. 3A, FIG. 3B, and FIG. 3C illustrate two axial grooves 137*a*, 137*b*, the clamp retainer 136 may be used with any plurality of axial grooves. For example, 3, 4, 5, 6 or more axial grooves may be used with the clamp retainer 136.

Figure 4A:
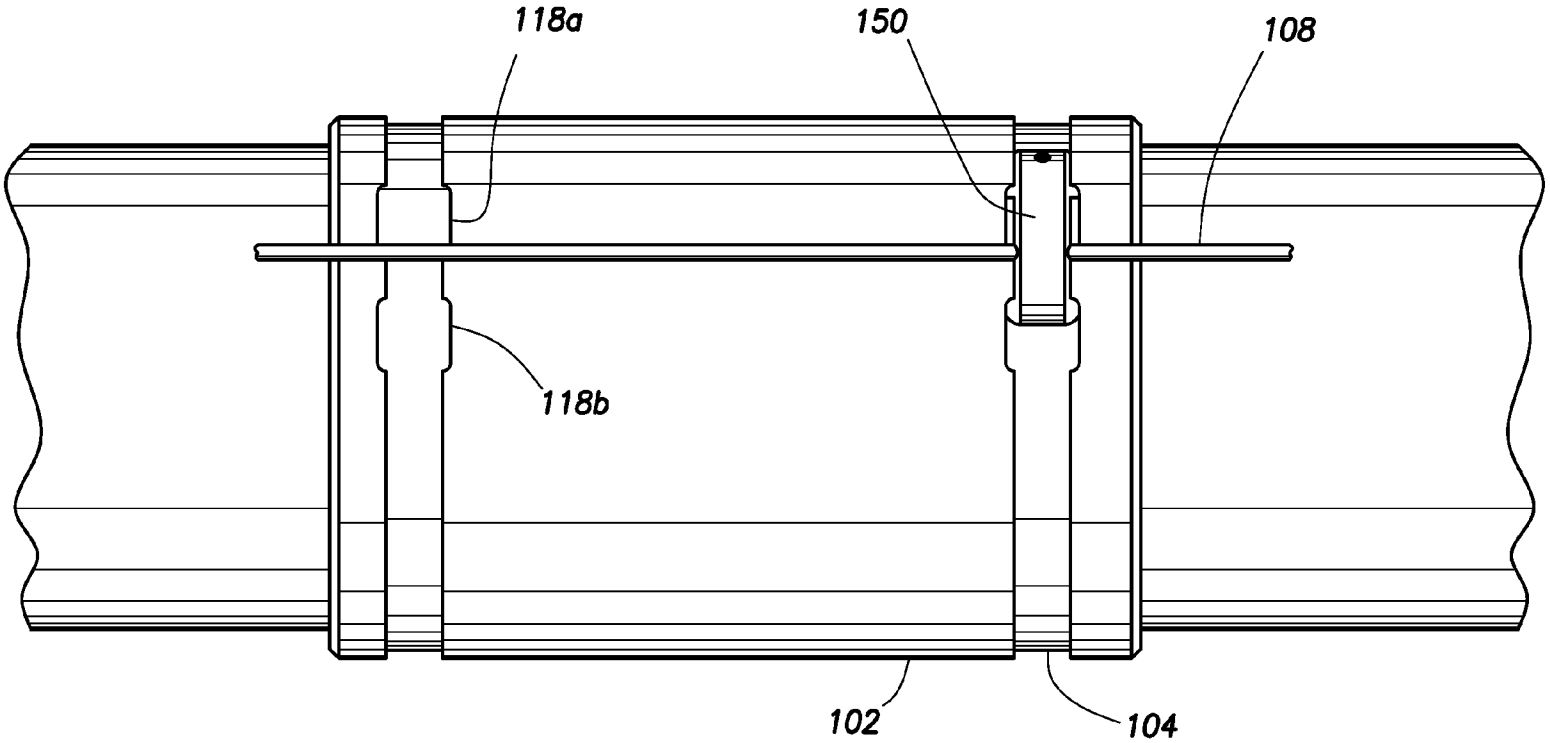
FIG. 4A is an illustration of a clamp, a tubular, and a control line according to an embodiment of the disclosure.
Figure 4B:
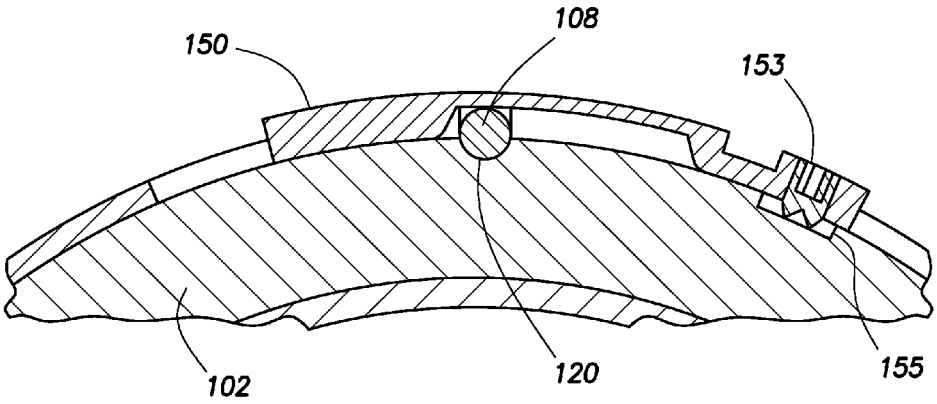
FIG. 4B is an illustration of a clamp in section according to an embodiment of the disclosure.
Figure 4C:
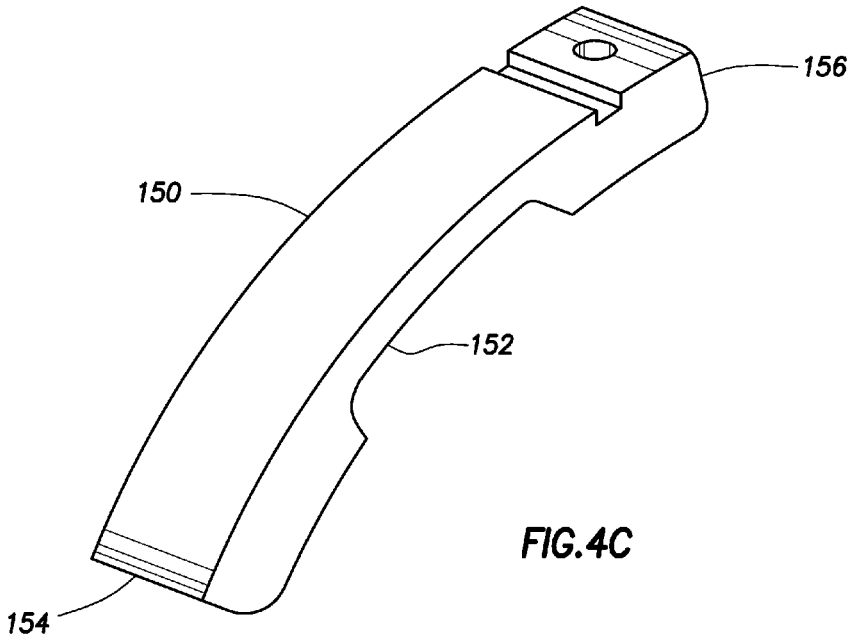
FIG. 4C is an illustration of a clamp according to an embodiment of the disclosure.

Turning now to FIG. 4A, FIG. 4B, and FIG. 4C, another embodiment of the clamp assembly 106 is described. In an embodiment, the clamp assembly 106 comprises a single clamp 150. The single clamp 150 comprises an axial groove 152 that is deep enough to lay over the control line 108 but wide enough to promote placing the single clamp 150 over the control line 108 and then sliding the single clamp 150 to engage with the undercutting of the circumferential groove 104. The single clamp 150 in the area of the axial groove 152 is narrower than the outside of the circumferential groove 104 while a first end 154 and a second end 156 of the single clamp 150 are wider than the outside of the circumferential groove 104 and configured to engage with the undercutting 110, 112 of the circumferential groove 104. In an embodiment, the tubular 102 may be provided with two openings 118*a* and 118*b* in the circumferential groove 104 relatively close to and located either side of the axial groove 120. The single clamp 150 may be installed within the axial groove 152 bridging over the control line 108, with the ends 154, 156 in the openings 118*a*, 118*b*. The single clamp 150 may then be slid in the circumferential groove 104 until the ends 154, 156 of the single clamp 150 are captured by the undercutting 110, 112 of the circumferential groove 104. The single clamp 150 may then be secured against sliding in the circumferential groove 104 by use of a retaining mechanism 153 that engages to secure the single clamp 150 from circumferential motion in the circumferential groove 104. The retaining mechanism 153 may comprise a set screw that engages with a countersunk hole 155 in the tubular 102 or a deformable pin as described above with reference to the installation of the clamp assembly 106 comprised of the end clamps 130, 132 and the clamp retainer 134. Alternatively, the retaining mechanism may be provided by peening or deforming the edges of the circumferential groove 104 radially inwards.

Figure 5A:
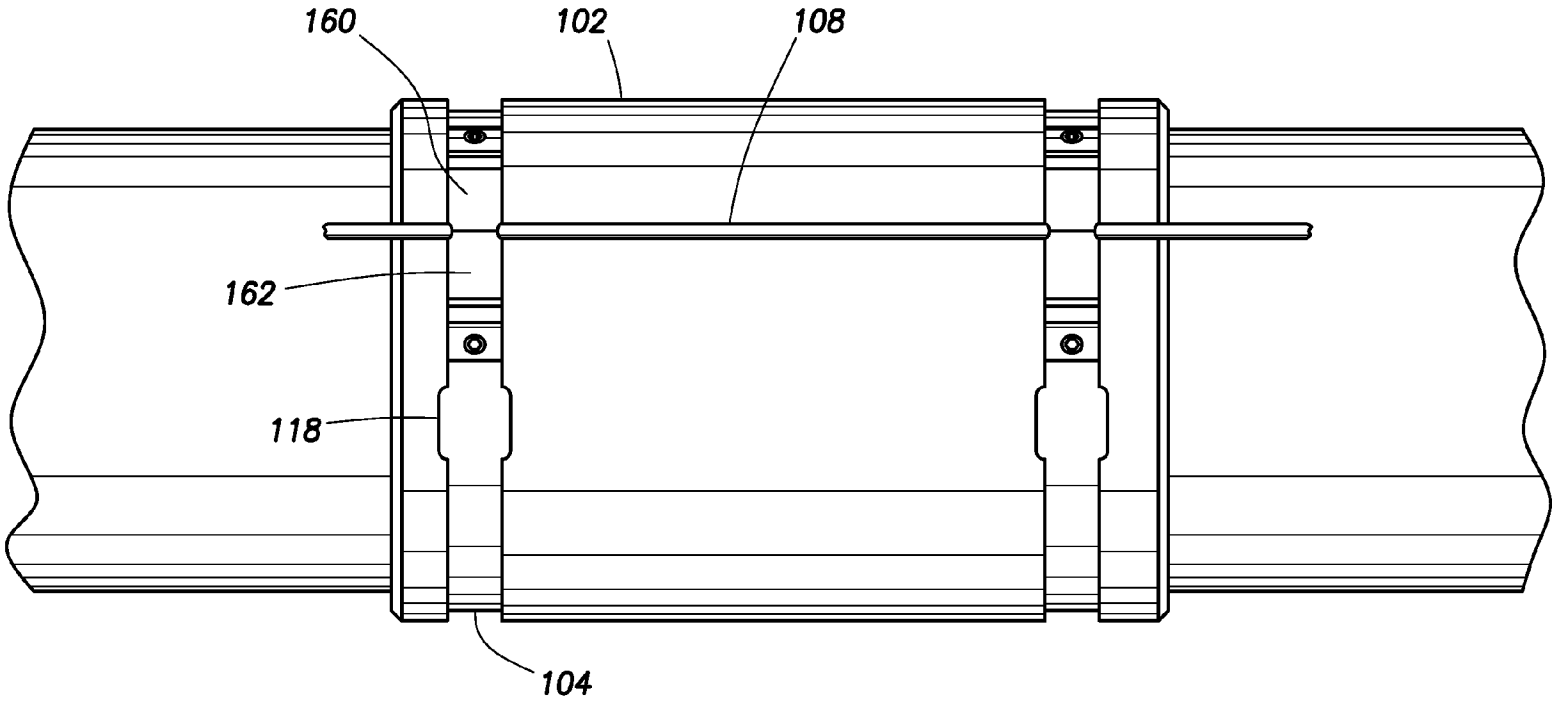
FIG. 5A is an illustration of a clamp assembly, a tubular, and a control line according to an embodiment of the disclosure.
Figure 5B:
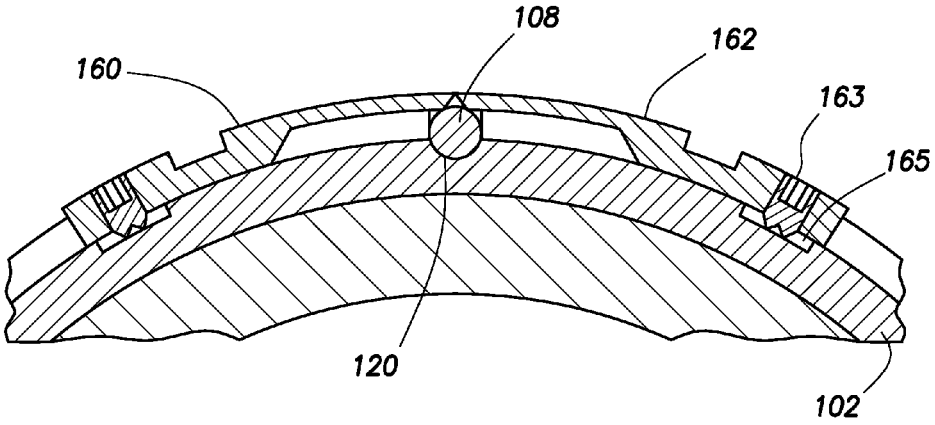
FIG. 5B is an illustration of a clamp assembly in section according to an embodiment of the disclosure.
Figure 5C:
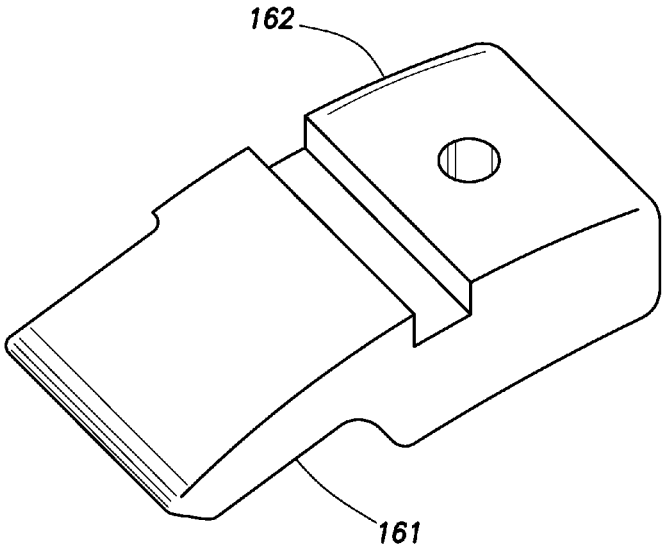
FIG. 5C is an illustration of a clamp according to an embodiment of the disclosure.

Turning now to FIGS. 5A, 5B, and 5C, another embodiment of the clamp assembly 106 is described. In an embodiment, the clamp assembly 106 comprises a first end clamp 160 and a second end clamp 162. The end clamps 160, 162 have an undercut edge that covers the control line 108 when the end clamps 160, 162 are slid over the control line 108 and secured in place with retaining mechanisms, such as set screws, deformable pins, or by peening the edges of the circumferential groove 104 as described above. An undercut 161 of the first end clamp 160 is illustrated in FIG. 5C. The second end clamp 162 has a substantially similar undercutting. In an embodiment, the first end clamp 160 may be the same or similar (e.g., structurally equivalent or substantially similar) to the second end clamp 162. One will readily appreciate that the end clamps 160, 162 may be used on either side of the axial groove 120 by rotating 180 degrees. The end clamps 160, 162 may be secured by one or more retaining mechanisms 163 engaging in a countersunk hole 165 in the tubular 102. The retaining mechanisms 163 may comprise set screws or deformable pins. Alternatively, the end clamps 160, 162 may be secured in other ways, for example by peening one or more edges of the circumferential groove 104.

Figure 6A:
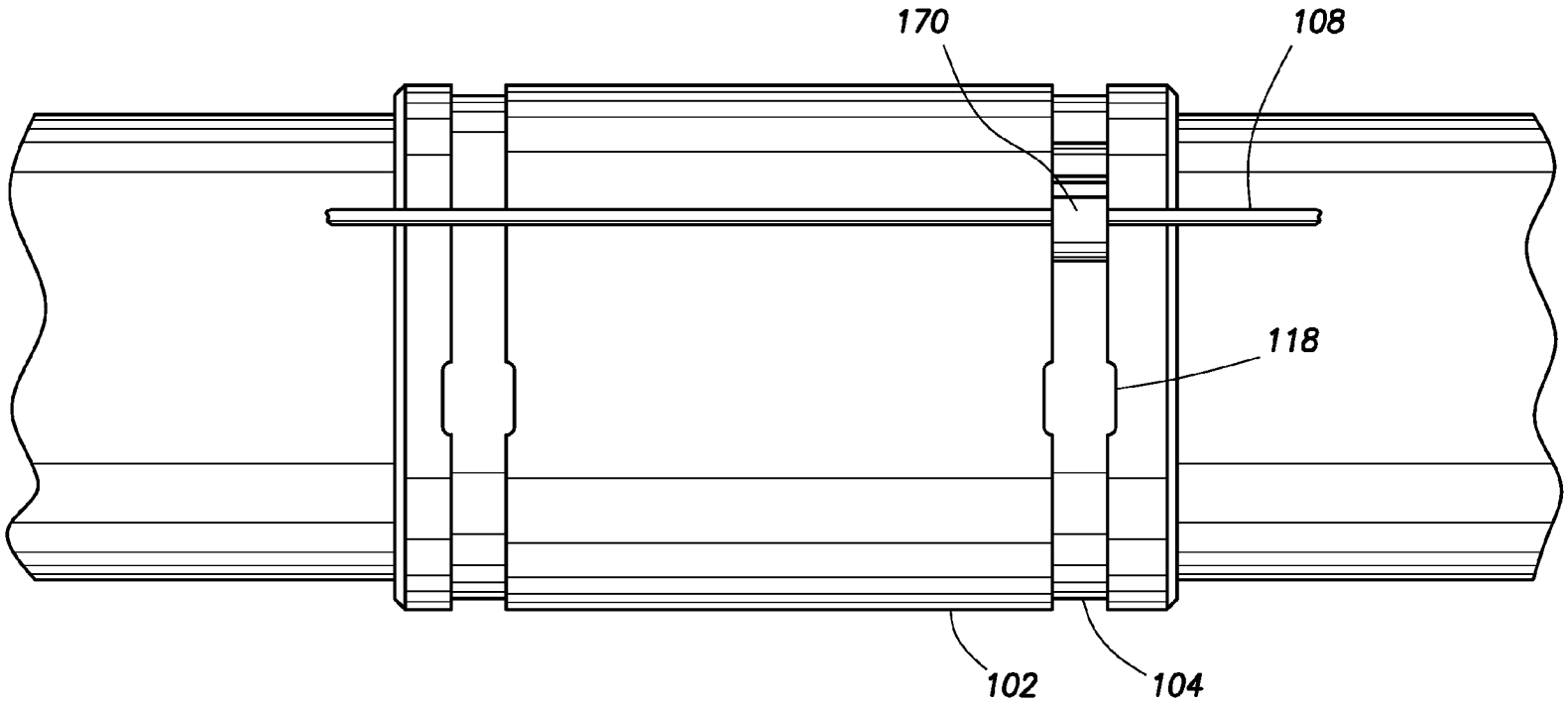
FIG. 6A is an illustration of a clamp, a tubular, and a control line according to an embodiment of the disclosure.
Figure 6B:
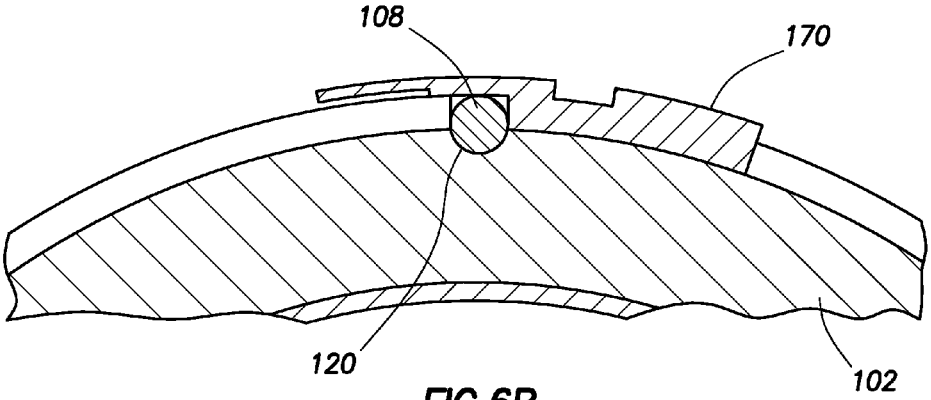
FIG. 6B is an illustration of a clamp in section according to an embodiment of the disclosure.
Figure 6C:
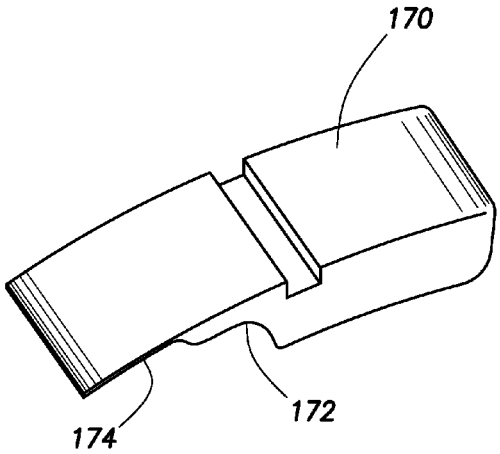
FIG. 6C is an illustration of a clamp according to an embodiment of the disclosure.

Turning now to FIGS. 6A, 6B, and 6C, another embodiment of the clamp assembly 106 is described. In an embodiment, the clamp assembly 106 comprises a single clamp 170. The clamp 170 has one end that is sized wide enough to be captured by the undercutting 110, 112 of the circumferential groove 104 and has a second end that features a deformable tab 174 that is thin, and a thicker undercut area 172 that is radiused to receive the upper part of the control line 108. The clamp 170 may be inserted into the opening 118, slid into position to cover the control line 108 while engaging with the undercutting 110, 112 of the circumferential groove 104. When in position, the clamp 170 may be secured against sliding in the circumferential groove 104 by deforming the tab 174 to engage the surface of the circumferential groove 104. In an embodiment, any of the embodiments of the clamp assembly 106 described above may be secured against sliding in the circumferential groove 104 by pinging down the outer edges of the circumferential groove 104 to capture the clamp assembly 106.

Any of the embodiments of the clamp assembly 106 may be combined along the length of the completion string 18 and/or production string. In other words, one embodiment of the clamp assembly 106 may be used for one securing of the control line 108 to the tubular and a different embodiment of the clamp assembly 106 may be used for the next securing of the control line 108 to the tubular 102. Any and/or all embodiments of the clamp assembly 106 may be used along the length of the completion string 18 and/or production string in any combination.

Any of the embodiments of the clamp assembly 106 described above may be used in a method to secure the control line 108 to the tubular 102, for example the production tubing 30 and/or the completion tool 32. This method comprises retaining the control line 108 to an outside of the tubular 102, where the tubular comprises the axial groove 120, and resisting a force applied to the control line 108 by transferring the force to the circumferential groove 104. For example, an axial force applied to the control line 108 may be transferred to the circumferential groove 104. Alternatively, a circumferential force and/or radial force applied to the control line 108 may be transferred to the circumferential groove 104. The clamp assembly 106 may support the control line 108 and transfer the force applied to the control line 108 to the circumferential groove 104, via engagement between the clamp assembly 106 and the undercutting 110, 112 of the circumferential groove 104 that captures the clamp assembly 106. In this sense, the combination of the clamp assembly 106 and circumferential groove 104 act as a force conversion mechanism to transfer the force from the control line 108 to the tubular 102.

Any of the embodiments of the clamp assembly 106 may be used in a method of coupling the control line 108 to the outside of a completion tubular, for example the tubular 102. The method may comprise placing a portion of the control line 108 in the axial groove 120 in the tubular 102, placing at least a portion of the clamp assembly 106 in the circumferential groove 104 in the tubular 102, over the control line 108; and sliding at least a portion of the clamp assembly 106 in the circumferential groove 104 to engage a retaining lip of the circumferential groove 104, for example the undercutting 110, 112 of the circumferential groove 104.

Figure 7:
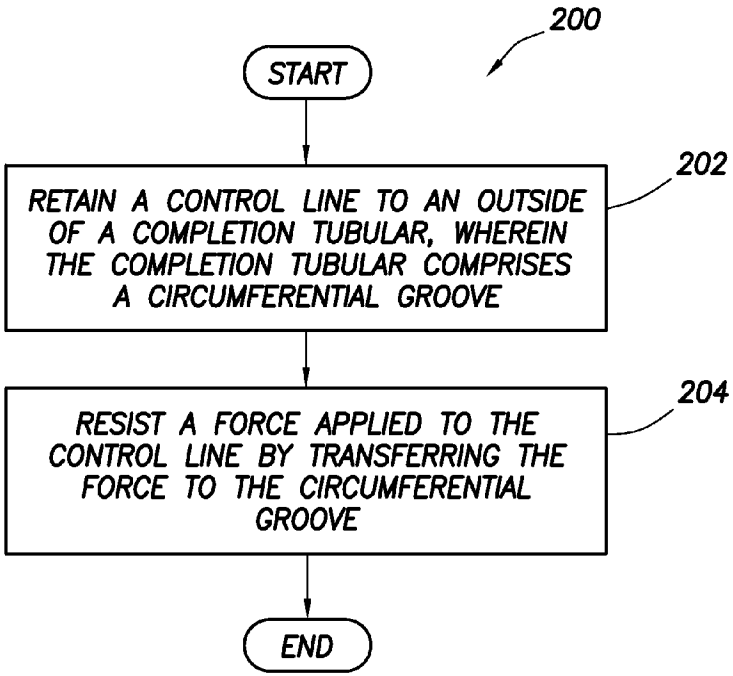
FIG. 7 is a flow chart of a method according to an embodiment of the disclosure.

Turning now to FIG. 7, a method 200 is described. At block 202, a control line is retained to an outside of a completion tubular, wherein the completion tubular comprises a circumferential groove. At block 204, a force applied to the control line is resisted by transferring the force to the circumferential groove. The force may be applied axially to the control line, and the axial force may be transferred to the circumferential groove. Alternatively, the force may be applied circumferentially to the control line, and the circumferential force may be transferred to the circumferential groove. Alternatively, the force may be a combined axial and circumferential force that is transferred to the circumferential groove. Alternatively, the force may be applied radially to the control line, and the radial force may be transferred to the circumferential groove. In an embodiment, a clamp retains the control line and transfers the force applied to the control line to the circumferential groove. The method 200 may comprise running the completion tubular and the control line into a wellbore. In an embodiment, the force is applied to the control line by the wellbore, for example by contact between the completion string 18 and the wellbore 12 during run-in of the completion string 18.

Figure 8:
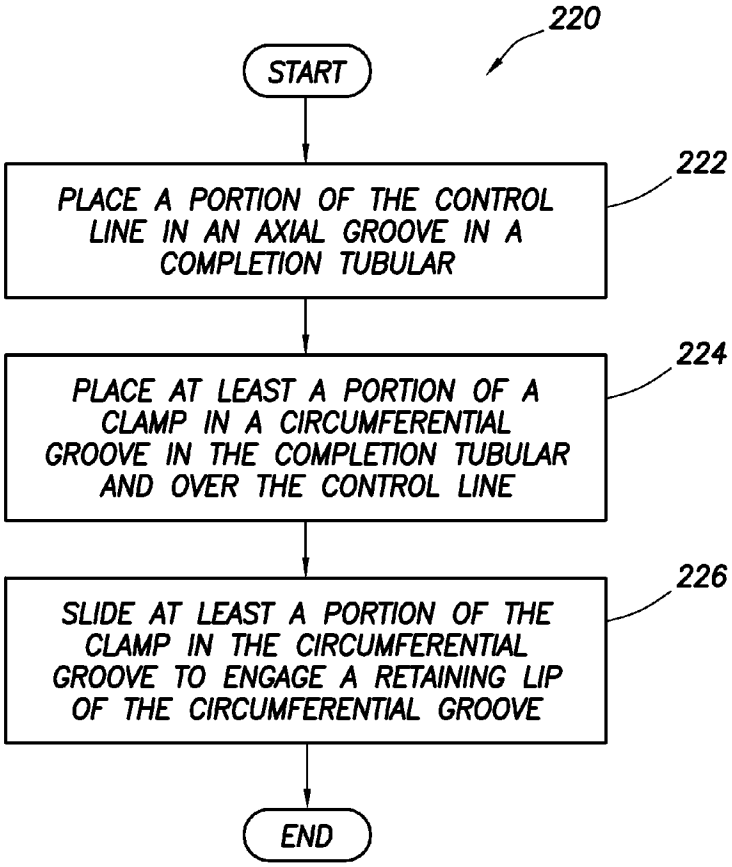
FIG. 8 is a flow chart of another method according to an embodiment of the disclosure.

Turning now to FIG. 8, a method 220 is described. At block 222, a portion of the control line is placed in an axial groove in a completion tubular. At block 224, at least a portion of a clamp is placed in a circumferential groove in the completion tubular and over the control line. At block 226, at least a portion of the clamp is slid in the circumferential groove to engage a retaining lip of the circumferential groove. The retaining lip may be provided by the undercutting 110, 112 of the circumferential groove 104 described above.

Placing at least a portion of a clamp over the control line may comprise placing a clamp retainer over the control line. The method 220 may further comprise placing a first end clamp in the axial groove, placing a second end clamp in the axial groove, and sliding the first end clamp and the second end clamp to secure the clamp retainer. The method 220 may further comprise securing the first end clamp by setting a set-screw in the first end clamp and securing the second end clamp by setting a set-screw in the second end clamp. The method 220 may further comprise deforming a tab portion of the clamp to secure the clamp in the circumferential groove.

The method 220 may further comprise deforming a portion of the retaining lip of the circumferential groove to secure the clamp in the circumferential groove. The method 220 may further comprise running the control line and the completion tubular into a wellbore. In an embodiment, the completion tubular is one of a coupler, an adapter, a packer, a sand screen, a sand screen shroud, a sand screen end ring, a sand screen middle ring, a casing joint, a pipe joint, coiled tubing, a completion tool, a gauge mandrel, a safety valve, and/or a mandrel on a travel joint.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of securing a control line to a wellbore tubular, comprising:

retaining a clamp within a circumferential groove in the wellbore tubular by retaining the clamp with at least an undercut upper edge of the circumferential groove and an undercut lower edge of the circumferential groove;

retaining the control line to an outside of the wellbore tubular via the clamp; and resisting a force applied to the control line by transferring the force via the clamp to the circumferential groove.

2. The method of claim 1, further comprising running the wellbore tubular and the control line into a wellbore.

3. The method of claim 2, wherein the force is applied to the control line by the wellbore.

4. A method of coupling a control line to an outside of a wellbore tubular, comprising:

placing at least a portion of a clamp in a circumferential groove in the wellbore tubular; and sliding at least the portion of the clamp in the circumferential groove to engage a retaining lip of the circumferential groove, wherein the clamp is configured to retain the control line adjacent the wellbore tubular.

5. The method of claim 4, wherein placing at least the portion of the clamp comprises placing a clamp retainer over the control line, and wherein the method further comprises placing a first end clamp in the circumferential groove, placing a second end clamp in the circumferential groove, and sliding the first end clamp and the second end clamp to secure the clamp retainer.

6. The method of claim 5, further comprising securing the first end clamp by engaging a first retaining mechanism with the first end clamp, and securing the second end clamp by engaging a second retaining mechanism with the second end clamp.

7. The method of claim 4, further comprising deforming a tab portion of the clamp to secure the clamp in the circumferential groove.

8. The method of claim 4, further comprising deforming a portion of the retaining lip of the circumferential groove to secure the clamp in the circumferential groove.

9. The method of claim 4, further comprising running the control line and the wellbore tubular into a wellbore.

10. The method of claim 4, wherein the wellbore tubular is at least one of a coupler, an adapter, a packer, a sand screen, a sand screen shroud, a sand screen end ring, a sand screen middle ring, a casing joint, a pipe joint, coiled tubing, a completion tool, a gauge mandrel, a safety valve, or a mandrel on a travel joint.

11. The method of claim 4, further comprising placing a first end clamp in the circumferential groove, placing a second end clamp in the circumferential groove, and sliding the first end clamp and the second end clamp toward each other to cover the control line.

12. The method of claim 5, further comprising placing the clamp retainer over two or more control lines, placing the first end clamp in the circumferential groove, placing the second end clamp in the circumferential groove, and sliding the first end clamp and the second end clamp to secure the clamp retainer over the two or more control lines.

13. A clamp system for use with a wellbore tubular comprising:

a wellbore tubular having a circumferential groove, wherein the circumferential groove is undercut on an upper edge of the circumferential groove and undercut on a lower edge of the circumferential groove; and a clamp, wherein the circumferential groove is configured to retain the clamp within the circumferential groove, wherein the clamp is retained at least in part by the undercut upper edge of the circumferential groove and the undercut lower edge of the circumferential groove.

14. The clamp system of claim 13, wherein the wellbore tubular defines a cut-out portion that is at least as wide as from the undercut on the upper edge of the circumferential groove to the undercut on the lower edge of the circumferential groove.

15. The clamp system of claim 13, wherein the clamp comprises a first end clamp, a second end clamp, and a clamp retainer, wherein the circumferential groove is configured to retain the first end clamp and the second end clamp, and wherein the first end clamp and the second end clamp are configured to retain the clamp retainer in the circumferential groove.

16. The clamp system of claim 15, wherein the clamp retainer comprises an axial groove in an inner face of the clamp retainer.

17. The clamp system of claim 15, wherein the clamp retainer comprises a plurality of axial grooves in an inner face of the clamp retainer.

18. The clamp system of claim 13, wherein the wellbore tubular further comprises an axial groove in an outer surface of the wellbore tubular.

19. The clamp system of claim 13, further comprising a retaining mechanism, wherein the retaining mechanism is configured to secure the clamp against translating in the circumferential groove of the wellbore tubular when the retaining mechanism is in a set state.

20. The clamp system of claim 13, wherein the clamp comprises a tab, wherein the tab is deformable, and wherein the tab is configured to secure the clamp against sliding in the circumferential groove of the wellbore tubular.

21. The clamp system of claim 13, wherein at least a portion of the clamp is configured to be deformed, and wherein the clamp is configured to resist translation in the circumferential groove of the wellbore tubular when at least the portion of the clamp is deformed.

22. The clamp system of claim 13, wherein at least a portion of the circumferential groove is configured to be deformed, and wherein the clamp is configured to be retained within the circumferential groove when at least the portion of the circumferential groove is deformed.

* * * * *